US005397262A

United States Patent [19]

Lii

[11] Patent Number: 5,397,262

[45] Date of Patent: Mar. 14, 1995

[54] KNIFE GRINDER

[76] Inventor: Chuen-Cherng Lii, No. 54, Alley 67, Lane 112, Chung Ching Rd., Taichung, Taiwan, Prov. of China

[21] Appl. No.: 87,421

[22] Filed: Jul. 8, 1993

[51] Int. Cl.[6] ..... B24B 7/00; B24B 9/00

[52] U.S. Cl. ..... 451/241; 451/196; 451/349

[58] Field of Search ..... 51/249, 102, 285, 128, 51/81 BS, 84 BS, 87 BS, 92 BS, 210, 173; 451/421, 241, 45, 282, 196, 203, 208, 224, 549, 349

[56] References Cited

U.S. PATENT DOCUMENTS

| | | | |
|---|---|---|---|
| 4,672,777 | 6/1987 | Dunkin | 51/128 |
| 4,723,375 | 2/1988 | Lindén | 51/128 |
| 5,245,791 | 9/1993 | Bigliano et al. | 51/128 |

FOREIGN PATENT DOCUMENTS

| | | | |
|---|---|---|---|
| 0154967 | 9/1985 | European Pat. Off. | 51/128 |

*Primary Examiner*—Bruce M. Kisliuk
*Assistant Examiner*—Derris H. Banks
*Attorney, Agent, or Firm*—Morton J. Rosenberg; David I. Klein

[57] ABSTRACT

An improved knife grinder is desinged to have a motor transmission axle which transmits one or two units of wheel axle with its angles which are facing one another and entend slightly upward and outward. A base is fixed onto the vertical bottom surface which extends from the wheel shaft in coordination with the bearing positioning wheel axle, onto the upper end of which an axle bush can be housed. One or two units of glaze wheel is fitted onto the outer edge of the axle bush. While a stripe column is housed onto the position which is corresponding to the axle bush at its interior. Extending outward from the glaze wheel, three layers made of such materials as plastic, foam and grinding cloth are formed. A stair face is set on the upper end of the plastic layer, into which a positioning cover can be housed, and its mutli-angled protrusive column will be housed into the axle bush positioning hole; while the multi-angled groove at the other end will allow the wheel axle to be tightly screwed by a scew nut. By housing onto the upper cover of the machine body outside the grinding wheel, opening grooves are set corresponding to the interior lateral side of the grinding wheel will form a knife resting face separately, and into the opening grroves the lateral surface of various kinds of knife tools can be inserted.

1 Claim, 8 Drawing Sheets

KNIFE GRINDER

BACKGROUND OF THE INVENTION

Generally speaking, a grindstone is usually used to sharpen the blades of tools such as a kitchen knife, a fruit knife and knives for other purposes once these knives become blunt. By means of applying the blade of a tool reciprocally on a grindstone, the blade will recover its sharpness. However, besides time and energy consuming, a considerable skill will also be needed to achieve an excellent blade sharpening effect. Otherwise, all one can do is to assign the sharpening work to a tool shop which specialized in the job. Besides the reason that the quality of grinding cannot be easily controlled when it is processed manually, the forementioned defects are also caused by the unavailability of of an electrical tool grinder which is featured for its portability, suitability for household use, energy-saving and rapidity.

In spite of the availability of such similar inventions as those disclosed under U.S. Pat. No. 3,258,878, U.S. Pat. No. 3,800,480, U.S. Pat. No. 2,775,075, U.S. Pat. No. 2,865,141, U.S. Pat. No. 2,860,452, U.S. Pat. No. 4,333,273 and U.K. Patent No. 2,123,323, but viewing from their structures, it can be seen that grinding wheels are being used for the sharpening of tools. Upon grinding, the edge surface of the grinding wheel will keep in contact with the blade of a knife for the grinding process. Due to the fact that it is made of a very hard steel, it can conduct a strong grinding against any tool which is being processed (especially effective against a tool made of steel or any tool which has no blade). However, the following defects can also be easily made:

1. When the hard grinding wheel is pressing against a tool, its hardness contact will produce an extremely strong counter-active force, which makes the tool unable to be held steadily, and thus will easily produce a jumping phenomenon, and will further cause intermittent contacts between the grinding wheel and the tool i.e. the grinding process of the tool will be conducted in an intermittent manner. In this way, the contacting angle and the depth between the blade and the grinding wheel will not be kept consistently. Therefore, the blade which is thus processed will not be even and smooth. That is to say, after grinding the sharpness of the blade is usually unsatisfactory.
2. As the surface of a grinding wheel is rather rough, the iron filings which is produced at the time of grinding will easily be adhered onto the surface of the grinding wheel. Such iron filings makes cleaning impossible. In addition, both the grinding wheel and the tool are of a hard nature. It makes wearing easy for the grinding wheel, which will have to be replaced frequently. However, as the installing of a grinding wheel is quite complicated, that makes replacement uneasy, and the expenses involved will also be very high.

In view of the above defects, with his years of experience in the manufacturing of knife tools, the inventor made up his mind to conduct an active continuous study and research in the said field. After repeated experiments and improvements, he managed to complete a knife-grinder for household use as disclosed under the present invention. And its main object lies in diminishing the size of the knife grinder to enable it be gifted with the features of easy portability and operation, with two grinding wheels which are facing one another and extending slighly outward and having an appropriate angle of elevation being driven by a motor to enable the two grinding wheels for easy replacement when necessary; and also enable two opening grooves to be set outside the grinding wheel and fixed onto the upper cover of the machine body by facing each other at the interior lateral side of the two grinding wheels to form a knife stand, so that a knife can be inserted into either one of the opening grooves according to the shape of the two lateral blades of the tool, to the ultimate effect of allowing it to be operated by everybody, rapidly processed, convenient and energy-saving.

BRIEF DESCRIPTION TO RELATED DRAWINGS

FIG. 1 solid view of the present invention.

DETAILED DESCRIPTION OF THE PREFERRED EMBODIMENTS

The present invention relates to the improvement of a knife grinder for household use, particularly denoting the one which is designed to sharpen the blades of various kinds of knife for household use in a portable, convenient, rapid and self-operated manner.

In order to porvide a further understanding of the structure, function, object and operation of the present invention, a detailed description is herby made in coordination with the diagramtic darwings hereof.

Figure 1:
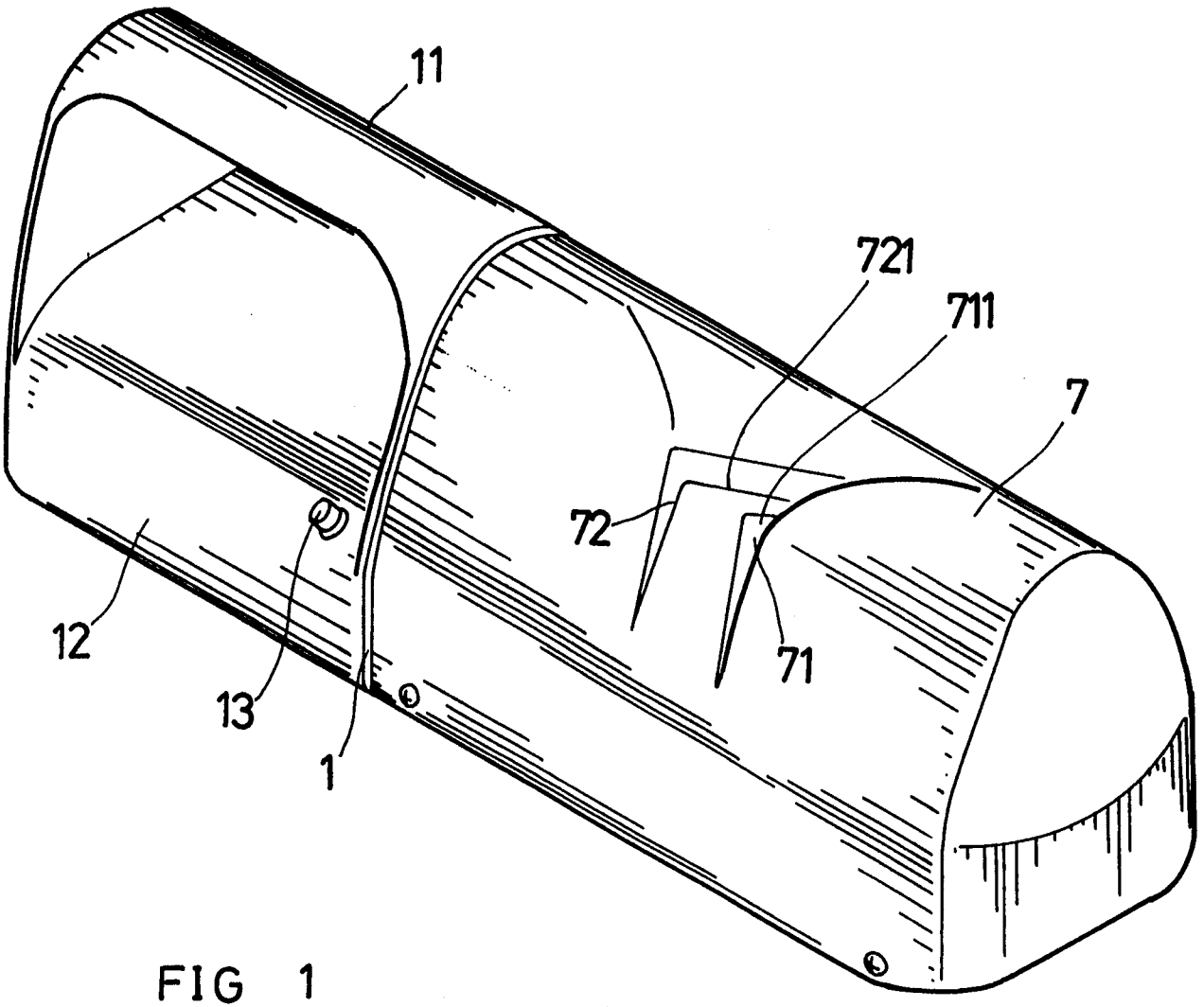
Figure 2:
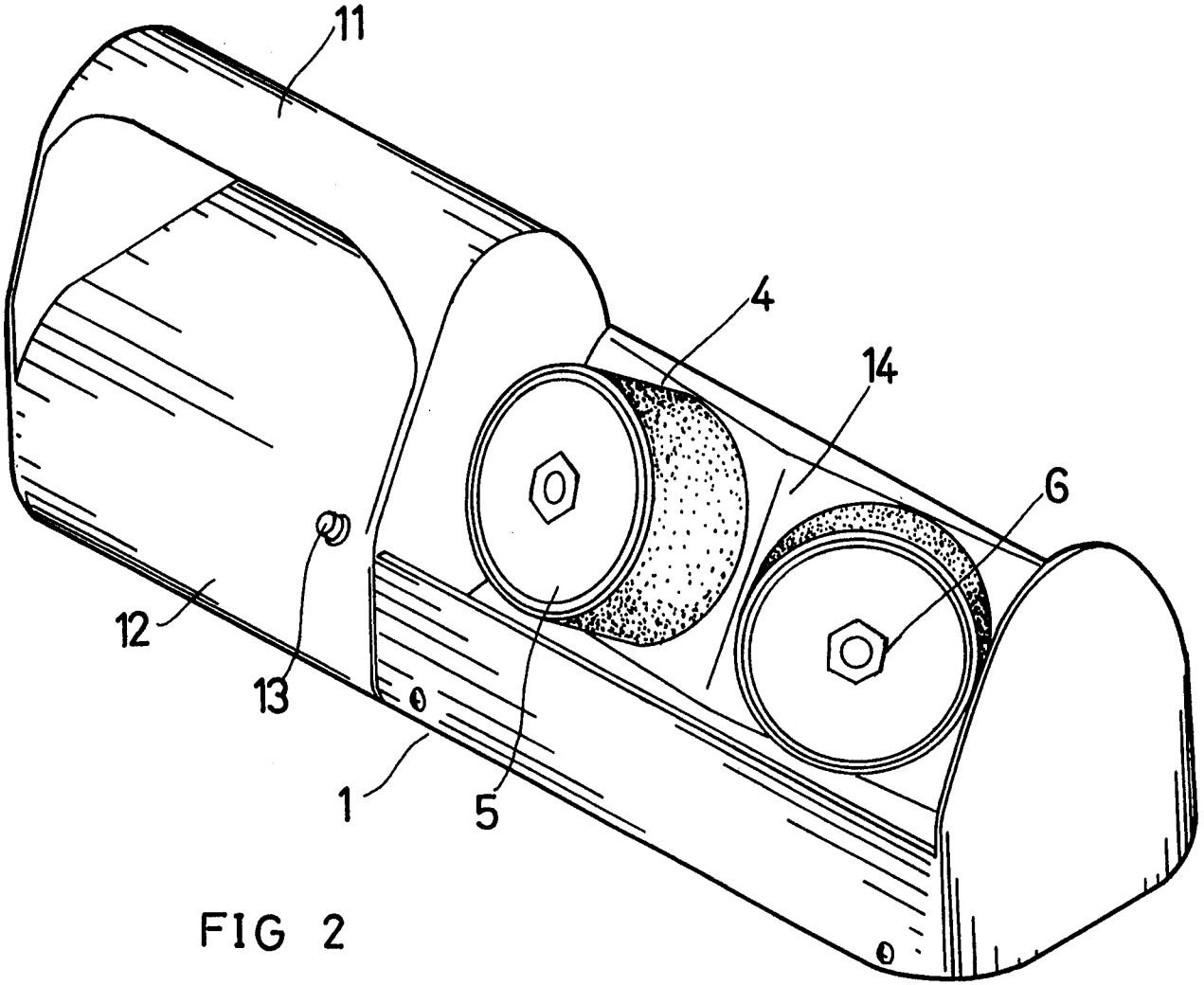
FIG. 2 is a structural indicative view of the the present invention in which the upper cover is removed.
Figure 3:
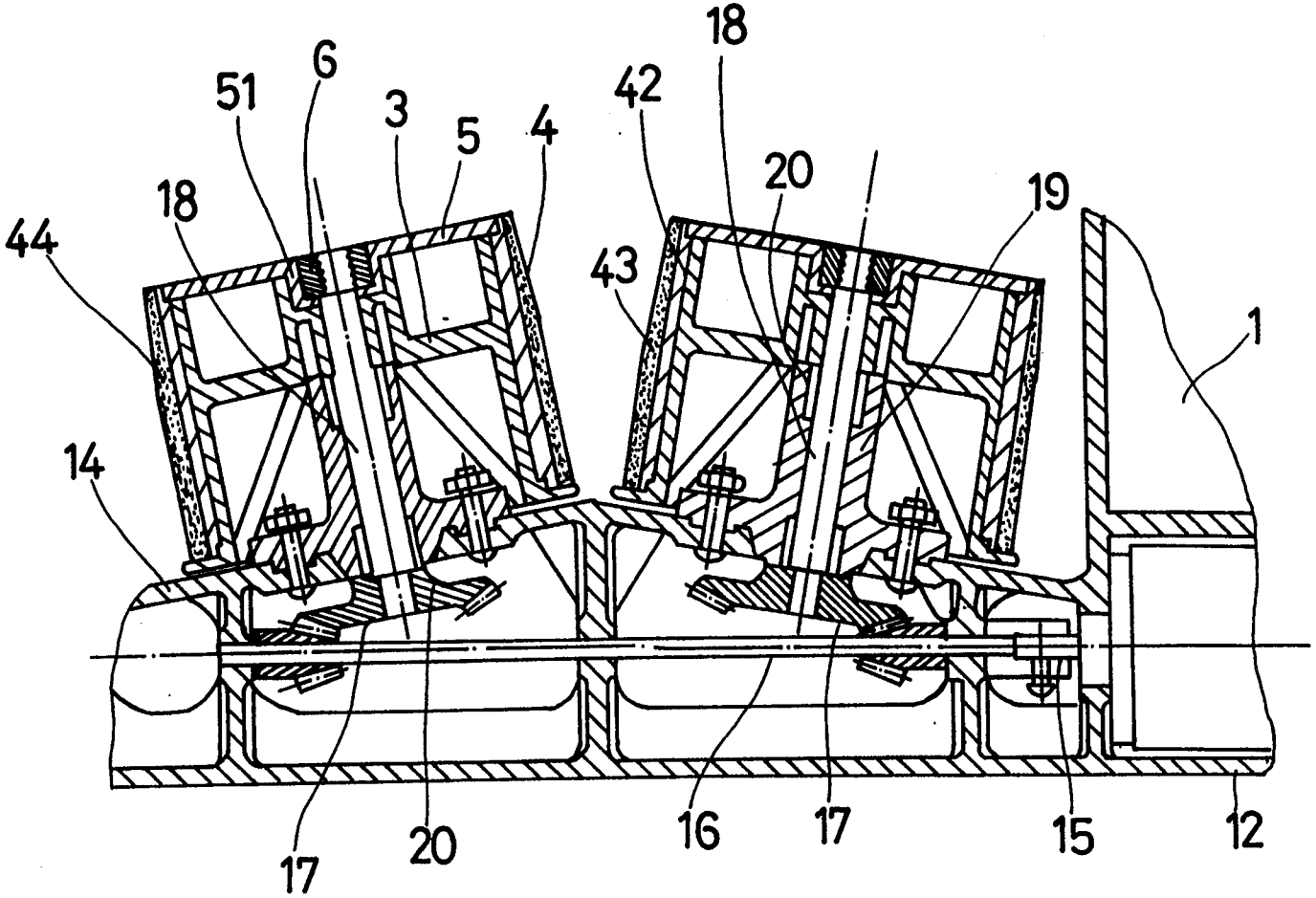
FIG. 3 is a sectional view of the transmission structure and grinding wheel of the present invention.
Figure 4:
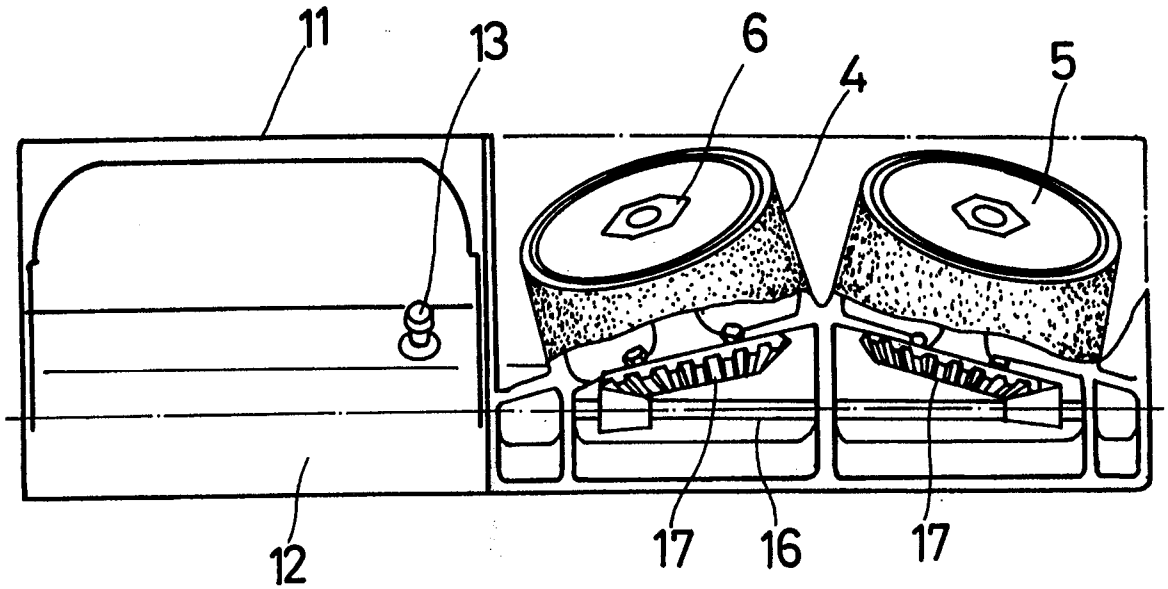
FIG. 4 is a front view indicative drawing of the present invention in which the transmission section is indicated.
Figure 5:
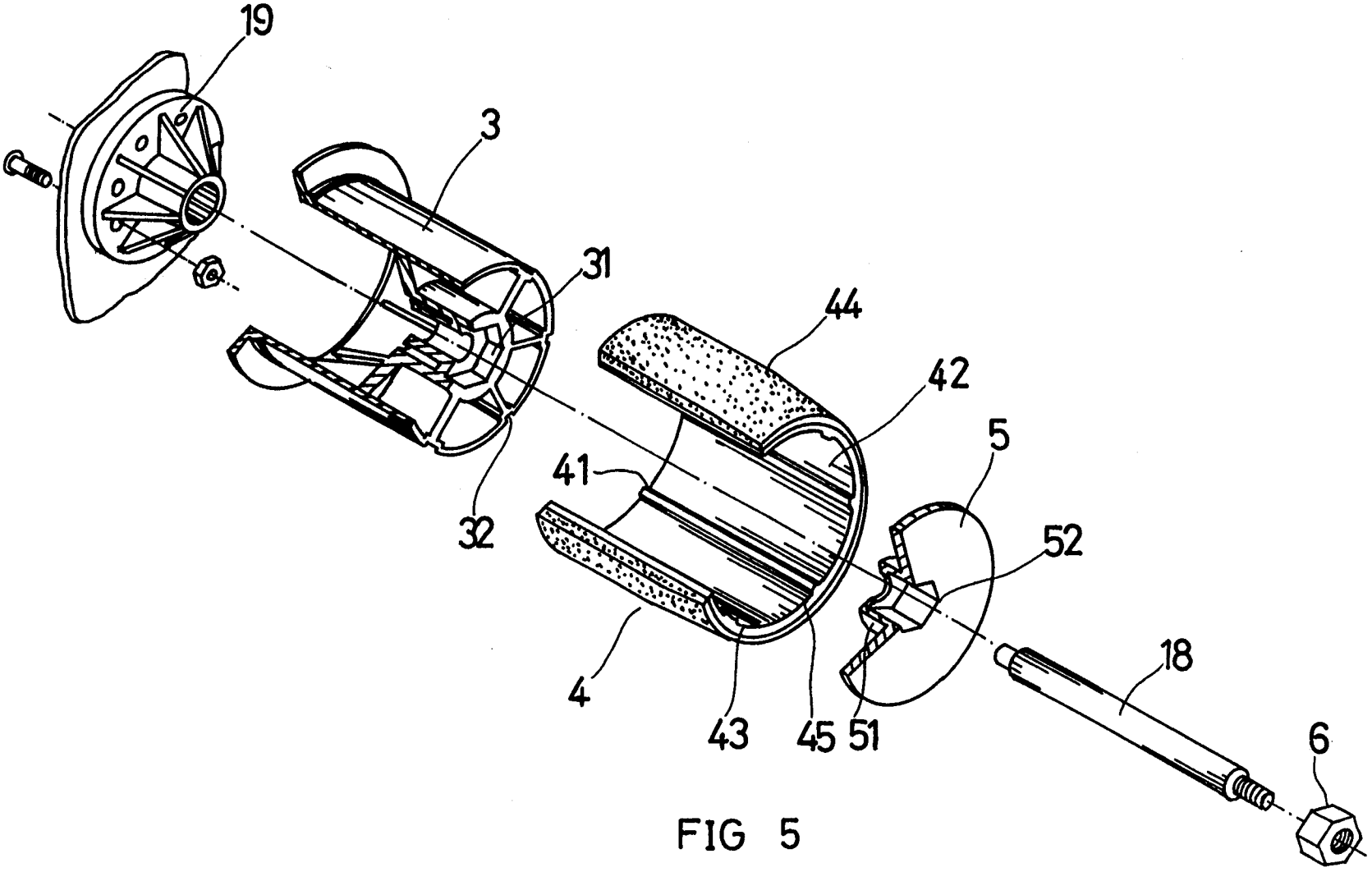
FIG. 5 is a solid segmentation view of the grinding wheel assembling members of of the present invention.
Figure 6:
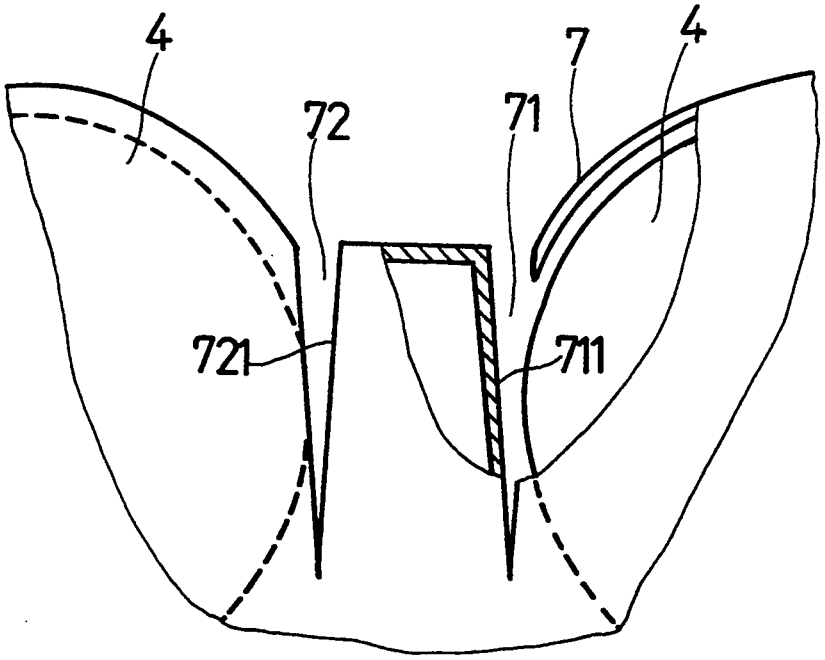
FIG. 6 is a drawing indicating the position of the upper cover and grinding wheel of the present invention.

Please refer to FIGS. 1–4, it can be seen that the knife grinder comprises a handle 11. and a dynamic force box 12. The switching of the dynamic force or change of speed are controlled by a button 13. A base face 14. is set at the other lateral side, and in its interior transmission axle 16. is connected by motor spindle 15. Corresponding to transmission axle 16, two oblique gear units 17. are set, each of which will transmit one or two units of wheel axle 18. in a slightly upward and outward direction to pierce through surfaces 14. which is located correspondingly in a vertical manner. A base seat 19 is fixed onto the base face 14. to cope with the positioning wheel axle 18. of bearing 20. As illustrated in FIG. 5, the upper end of wheel axle 18, and axle bush 3. can be mounted onto the outer upper end of base seat 19. while the upper end of axle bush 3. will form a multi-angled positioning hole 31. At the space lying in between the outer path a housing groove 32. is partitioned. At the outer edge of axle bush 3, one or two units of grinding wheel 4. is set. A stripe column 41. is set at the interior edge corresponding to housing groove 32. of axle bush 3, to enable it to be mounted outside the axle bush. The front end of grinding wheel 4. is made of a slight conical angle; while the outer diameter at its rear end is straight. Extending outward from the wheel body in the right order is a plastic layer 42, on elastic foaming layer 43. and a grinding cloth 44. While a stair face 45. is set on the upper end face of plastic layer to provide for the housing of a fixing cover 5, which will insert its protrusive multi-angled column 51. into the positioning hole 31. of axle bush 3. And the mult-angled groove 52. at the other end will allow wheel axle 18. to be screwed by screw nut 6. As illustrated in FIG. 6, two opening grooves 71. 72. are set at the interior lateral side of another upper cover 7. which is mounted outside grinding wheel 4. and fixed onto machine body 1. corresponding to the two grinding wheels 4. will form knife rests 711. 712. respectively.

The present invention is having two grinding wheels 4. because there are a great variety of blades of knives, which may be classififed into two kinds, namely, single-blade or twin-blade. When grinding process is needed for the right lateral side of the blade, put the tool into opening groove 71. or 72, then press the left lateral surface against the knife resting surface 721. or 711. to keep them in contact for the grinding process. When grinding process is needed for the left lateral side of the blade, press the right lateral side of the blade against the blade resting surface 711. or 721. of opening groove 721. or 711. After fixing upper cover 7, the position of opening grooves 71. 72. will allow them to maintain a fixed position relation with grinding wheel 4. And opening grooves 71. 72. and knief rests 711. 721. will form an appropiate angle to enable an easier operation as well as to ensure the quality of knife grinding.

Figure 7:
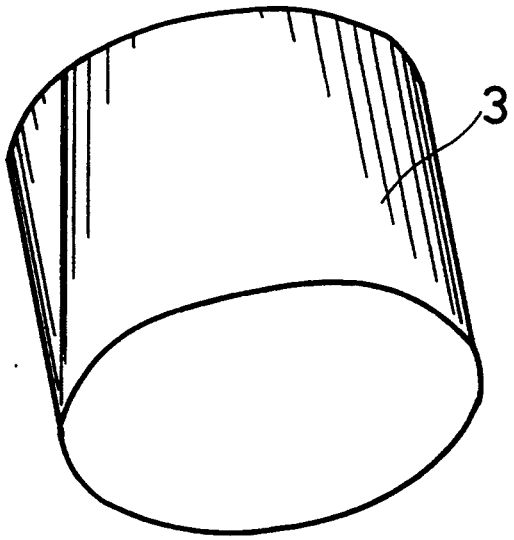
FIG. 7 is a drawing indicating the cutting line when the blade of a tool is being ground by the grinding wheel of the present invention.
Figure 8:
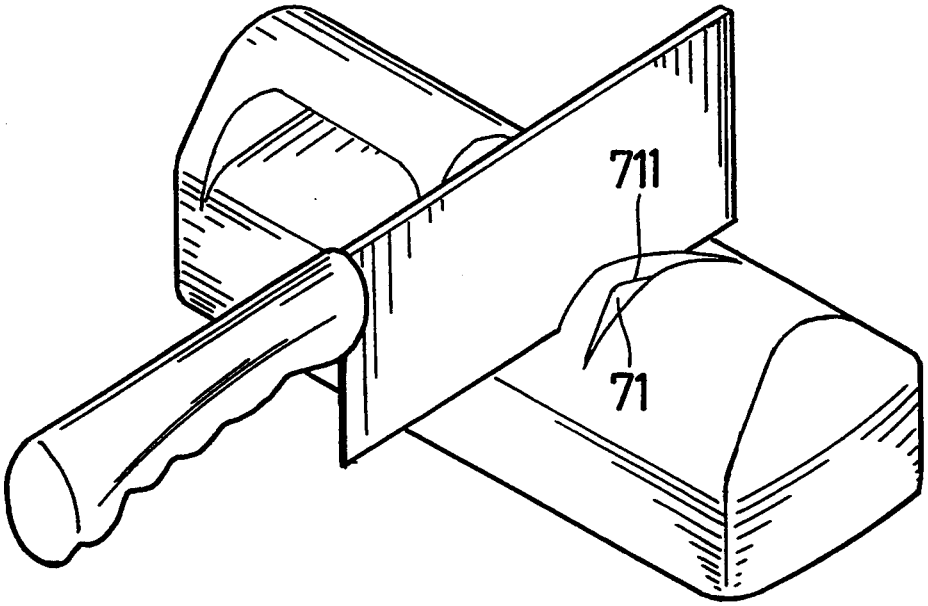
FIG. 8 is a preferred embodiment of a tool with a comparartively thicker blade used in the present invention.
Figure 9:
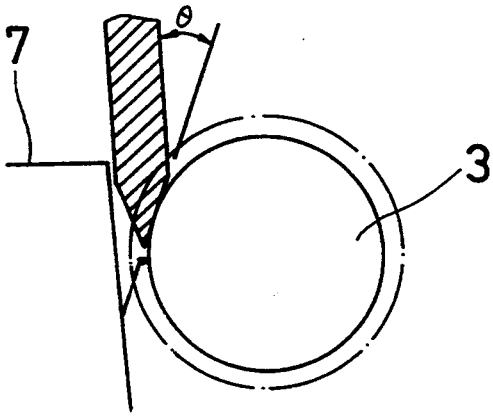
FIG. 9 is a sectional view of FIG. 8 of the present invention
Figure 10:
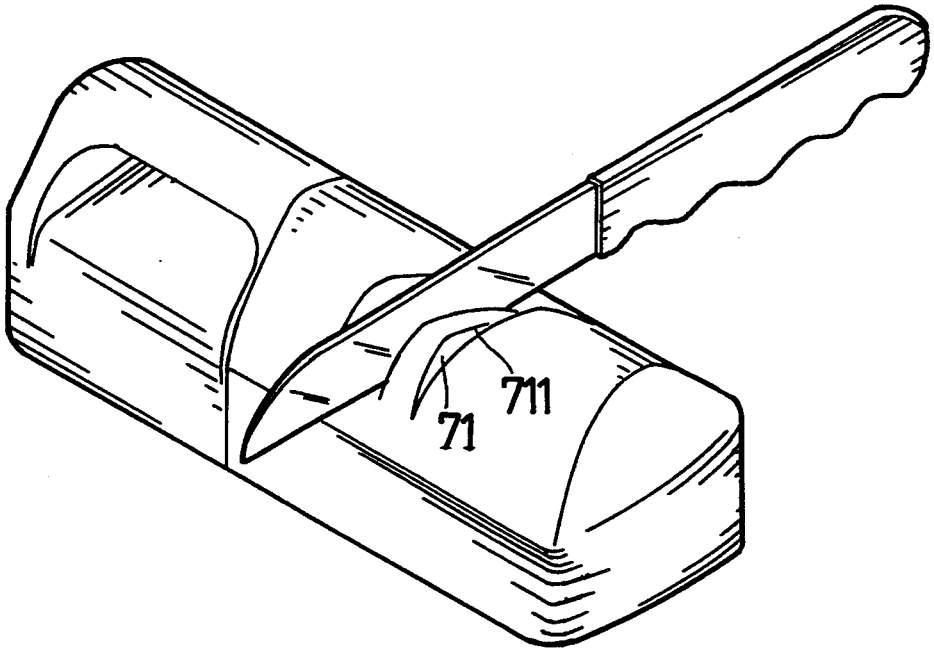
FIG. 10 is the preferred embodiment of a tool with a comparatively thinner blade used in the present invention.
Figure 11:
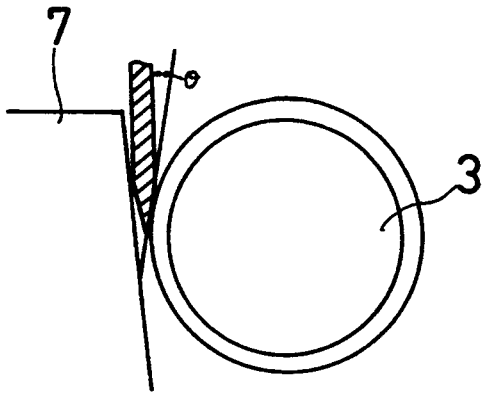
FIG. 11 is a sectional view of FIG. 10 of the present invention.

Twin grinding wheel 4 are facing one another in a 10 degree of oblique angle as well as having approximately 40 degree of angle of elevation on the base surface 14 and the bottom surface of machine body 1 to make the knife tool perform in the same way as indicated in FIG. 7. The line which is joined by the knife and the contacting point of grinding wheel 4. will form an oblique cutting line to enable it to achieve a better grinding effect. When the knife tool for grinding has a wider and thicker blade (such as a kitchen knife). please refer to FIGS. 8. 9. for operation, which indicated that the knife tool is put into opening groove 71. or 72. to enable the knife tool to get in touch with the front end obliquely conical face of grinding wheel 4. for grinding process. As the wedged angle 0. between the front end obliquely conical surface of grinding wheel 4. and knife rest 711. or 721. is comparatively larger, it is more suitable for grinding knife tools with a wider and thicker blade. When gridning process is needed for a knife tool with a blade which is thinner and flatter (such as a fruit knife), please refer to FIGS. 10. 11. for operation, which indicated that the knife tool is inserted into opening groove 71. or 72. to enable knife tool to get in touch with the rear end straight surface of grinding wheel 4. for a grinding process. As the wedged angle 0. between the rear end straight surface of grinding wheel 4. and knife rest surface 711. is comparatively smaller, it is suitable for grinding a knife ,tool with a blade which is thinner and flatter.

Grinding wheel 4 of the present invention is positioned by inserting the interior diameter stripe column 32. of axle bush 3. which is fixed by screw nut 6, and thus is featured to have a simple replacement function in assembling. And the structure of grinding wheel 4 is integrally formed by three layers which are made of different materials or is made of a separate type of assembling consisting of a plastic layer 42. an elastic foaming layer 43. and grinding cloth layer 44, for which please refer to FIG. 6. It may also be integrally formed by plastic layer 42. and elastic foaming layer 43. While the grinding cloth layer 44. will be formed independently or plastic layer 42. will be formed independently, while elastic foaming layer 43. and grinding cloth layer 44. will be integrally formed. Such a multi-styled structure is designed to provide the users with a self-assembling process which can be easily and conveniently operated. In addition, as the unique feature of elastic foaming layer 43. can get rid of the counter-active force and vibration at the time of grinding, it enables the knife tool to have a sharpener blade after grinding. It also improve the defects of the uneasiness in controlling and the impossibility in obtaining an even and smooth blade when the grinding of a knife tool is made by a grinding wheel which is hard in structure.

Summarizing the above, it can be seen that by means of its unique design and structure, the present invention managed to provide a knife grinder for household use. Its unique design allows the users to complete the knife grinding process easily without any prior experience or technique.

I claim:

1. An improved knife grinder for a knife comprising:

a body including a base having a base face, a motor spindle disposed in said base, a transmission axle disposed in said base and coupled to said motor spindle, two wheel axles coupled to said transmission axle and extending upward and outward through said base face, said two wheel axles facing each other in a 10-degree oblique angle and including an approximately 40-degree angle of elevation relative to said base face, two axle bushes secured to said wheels axles and each including an outer peripheral surface having at least one groove formed therein, two grinding wheels engaged on and secured to said axle bushes respectively and each including a plastic layer having at least one stripe column formed therein for engaging with said groove of said axle bushes, a foaming layer and a grinding cloth layer, said plastic layer including a stair face formed therein distal to said base face, said grinding wheels including lateral sides and each including a straight portion close to said base face and a conical portion distal to said base face, two fixing covers engaged in said stair faces of said grinding wheels respectively and each including a multi-angled column engaged in said axle bushes respectively and having a multi-angled groove formed therein, said wheel axles including a free end extended into of said multi-angled grooves respectively, two nuts engaged in said multi-angled grooves for engaging with said free ends of said wheel axles, and an upper cover fixed onto said body for housing said grinding wheels, said upper cover including two opening grooves located corresponding to said lateral sides of said grinding wheels so as to form knife rests respectively for insertion of said knife.

* * * * *